US005477659A

United States Patent [19]

Conrad et al.

[11] Patent Number: 5,477,659

[45] Date of Patent: Dec. 26, 1995

[54] METHOD AND ARRANGEMENT FOR THE PACKAGING OF A MATERIAL-WEB ROLL

[75] Inventors: Hans-Rolf Conrad, Dormagen; Franz Kayser, Geldern, both of Germany

[73] Assignee: Sulzer Papertec Krefeld GmbH, Krefeld, Germany

[21] Appl. No.: 236,502

[22] Filed: Apr. 29, 1994

[30] Foreign Application Priority Data

May 3, 1993 [DE] Germany ..... 43 14 480.2

[51] Int. Cl.[6] ..... B65B 31/02

[52] U.S. Cl. ..... 53/432; 53/440; 53/372.8; 53/372.9; 53/480; 53/510; 53/127

[58] Field of Search ..... 53/432, 434, 415, 53/440, 510, 512, 127, 136.2, 480, 372.8, 372.9

[56] References Cited

U.S. PATENT DOCUMENTS

| | | | |
|---|---|---|---|
| 2,851,839 | 9/1958 | Himes et al. | 53/372.9 |
| 3,299,603 | 1/1967 | Shaw | 53/434 |
| 3,527,018 | 10/1968 | Jahnke | 53/512 |
| 3,828,523 | 8/1974 | Brenner et al. | 53/372.9 |
| 4,369,611 | 1/1983 | Canfield | 53/127 |
| 4,485,612 | 12/1984 | Piesen et al. | 53/372.9 |
| 4,524,562 | 6/1985 | Yagi et al. | 53/136.2 |
| 5,016,423 | 5/1991 | Spatafora et al. | 53/372.8 |
| 5,174,095 | 12/1992 | Fujiwara et al. | 53/480 |

FOREIGN PATENT DOCUMENTS

| | | |
|---|---|---|
| 0494750A1 | 1/1992 | European Pat. Off. . |
| 0499954A1 | 2/1992 | European Pat. Off. . |
| 3128114A1 | 7/1981 | Germany . |
| 4135075A1 | 10/1991 | Germany . |

*Primary Examiner*—John Sipos
*Assistant Examiner*—Gene J. Kim
*Attorney, Agent, or Firm*—Darby & Darby

[57] ABSTRACT

A method and an arrangement for the packaging of a material-web roll, includes the roll being surrounded on all sides by packaging material. The packaging material is closed by a pleating device for the pleating of the axial projections of the packaging material on the end faces of the roll. A device for applying the outer end face covers is also included. When packaging the roll, air is enclosed within the package which often results in a bursting of the package when the roll is being deposited on one of its end faces. To avoid this bursting, a portion of the air mass is removed from the interior of the packaging material and after closing the package, the volume of the still enclosed air is being reduced by the provision of a heating device for heating at least a portion of the air volume being enclosed by the packaging.

11 Claims, 2 Drawing Sheets

METHOD AND ARRANGEMENT FOR THE PACKAGING OF A MATERIAL-WEB ROLL

FIELD OF THE INVENTION

The present invention relates to a method for the packaging of a material-web roll in which the roll is surrounded on all sides by packaging material and the packaging material is closed, and an arrangement for the packaging of a material-web roll, a pleating device for the pleating of axial projections of the packaging web projecting beyond the end faces of the roll, and a device for applying an end face cover.

BACKGROUND OF THE INVENTION

In the process of packaging material-web rolls, such as paperweb rolls, it is common to initially apply an inner end face cover to each end face of the roll. Thereafter, the material-web roll is circumferentially shrouded by a packaging web which, as a rule, surrounds the roll in several layers and also projects somewhat beyond the roll axially. The axial projections are pleated during or after the shrouding of the roll so that the resulting pleats abut against the end faces. Finally, an outer end face cover is applied to each end face of the shrouded roll and, as a rule, are glued thereto. Such an arrangement or method is known from EPO 499 954 A1, for example. The inner end face cover can be omitted when a suitable outer end face cover is being used as is known from EPO 494 750 A1, for example.

The packaging of a roll not only serves as a mechanical protection against soiling or damaging from the outside. The packaging should also be sufficiently tight so that, by way of example, variations of the humidity of the ambient air do not negatively influence the material-web that has been wound on the roll.

Such relatively tight packaging, however, creates other problems because during the act of packaging and especially when applying the outer end face covers, it is practically impossible to prevent air from being enclosed within the package. The packaging material thereby does not lie uniformly and closely against all surfaces of the roll, especially when air is trapped at the end faces of the roll such as, for example, within the pleats of the axial projections or between the pleats and the roll. Such trapped air can also cause a bursting of the package when depositing the packaged roll on one of its end faces.

SUMMARY OF THE INVENTION

An object of the present invention therefore is to improve the packaging of a roll. This object is achieved, in the method mentioned above, in that before closing the packaging material, a portion of the air volume within the package is removed, and after closing the package, the volume of the still remaining air is still being reduced. By reducing the volume of the remaining air, air remnants are substantially removed from between the pleats and from between the outer end face covers and the end faces of the roll. The packaging material thereby closely hugs the roll. It is not necessary, however, that the air be completely removed. The volume of trapped air is being reduced to such an extent so that a compression of the remaining air does not result in a bursting of the package when the roll is being deposited on one of its end faces, for example. The package itself is somewhat yieldable which is, however, to a relative small extent. By removing a portion of the air volume from the interior of the packaging material prior to closing the same, it is practically guaranteed that after closing the package, a reduction in the air volume is in fact achieved and it is permanent, because in the interior of the package there is indeed less air.

In a preferred embodiment, a portion of the air within the interior of the packaging material is being warmed up prior to closing the package and is being cooled after closing the same. When air is being warmed up, the same will expand and a portion of the air will be expelled. Another portion of the warmed up air will be trapped within the package when the roll is packaged. As soon as the packaged roll has been cooled to the ambient temperature, the volume of the trapped air will be reduced so that detrimental air bubbles are substantially removed. The temperature to which the air can be warmed up is only practically limited by the nature of the material web to be packaged. Of course, the temperature should be kept as low as possible because of energy considerations. Which temperature is most suitable can easily be determined by conducting simple tests. In many instances it is sufficient for the volume of the air, when cooling, to be reduced by 30–50%.

Advantageously, a hot air curtain is created in front of the end face of the roll before the packaging material is closed. When pleating the axial projections and when pressing on the outer end face covers, heated air then migrates into the pleats as well as into the area between the outer end face cover and the roll, whereby the air volume is drastically reduced during the subsequent cooling process. Exactly, in the critical areas of the roll, the inclusion of detrimental air bubbles or pockets is avoided.

Alternatively and/or additionally, heated air can be blown into the interior of the packaging material. This results in a predetermined air exchange from cold to warm or hot air in the roll, i.e., in the interior of the packaging material.

In a further preferred embodiment which is useable in addition to the above mentioned method steps, an inner end face cover is fastened to a hollow roll core and the interior of the roll core is filled with warmed-up air. The interior of the roll core possesses a relative large volume when compared to the volume of air enclosed at the end faces of the roll during packaging. When the air in the roll core is now heated or exchanged for heated air, one achieves a practically air-free packaging at the end faces when the roll is being cooled. The end faces of the roll can thereby be subjected to high handling forces. Herein, it is especially preferred that the inner end face cover be provided with a through passage which constitutes a communication from the interior of the roll core to the outside through which hot air can be blown into the interior. The hollow roll core has already been provided with an inner end face cover. This inner end face cover, however, does not completely seal the interior of the hollow roll core but it does prevent a rapid escape of the warmed-up air. The end face cover does allow for a gradual pressure equalization between the end faces and the interior of the roll core when the air is cooling off, so that the excess air present at the end faces of the roll reaches the interior of the roll core after a certain lapse of time.

Preferably, the hot air is blown into the interior of the roll core by means of at least one probe inserted through the through opening, whereby the air being expelled can escape between the probe and the circumference of the through opening. This allows for a quick air exchange, whereby the colder air under pressure of the hot air is pushed through the through opening. A probe could also be inserted into both end faces. Without a corresponding pressure, the inner end face cover offers a sufficient flow resistance to hinder a quick escape of the hot air from the roll core.

It is preferred that the air warm-up occurs during the pleating of the projections of the packaging material. In this case, the air being enclosed while pleating is simultaneously warmed-up so that while cooling, the air pockets created during pleating will practically disappear.

Instead of warming-up the air or in addition thereto, an auxiliary body can be inserted into the package prior to closing the packaging material, that is, from the volume being shrouded by the packaging material. The auxiliary body, which inherently is capable of consuming air, consumes air from the air reservoir which was entrapped when the package was being closed.

The auxiliary body could constitute a container having a partial vacuum and having a closeable throttle opening being opened just prior to closing the package. As soon as the throttle is opened, the negative pressure in the container serves as a source for the air to flow into the container to effect a pressure equalization. Because of the fact that the throttle opening is opened just prior to closing the package, the pressure equalization is accomplished by the vacuum container feeding mostly from the enclosed air so that the air that is of a detrimental value at the end faces is removed therefrom and the air pockets disappear. Also, the auxiliary body could constitute a chemical substance capable of binding components of the air such as oxygen or hydrogen which would result in a reduction of the enclosed air volume. Preferably, the auxiliary body can be placed inside the roll core because of sufficient space being available there.

The object of the present invention, as mentioned above, is achieved in that a heating device for warming at least a portion of the air is arranged in a volume surrounded by the packaging web. The heating device warms the air which is enclosed by the packaging web. After closing the package, the air is gradually cooling off which results in a volume reduction. Air pockets or air inclusions, which could be of a detrimental value, are removed.

Preferably, the heating device is located in the area of the pleating device. On one hand, the necessary space is available here and on the other hand, precisely when pleating, a relative large volume of air is enclosed here, so that the air being enclosed is already in a warmed-up state.

The heating device, preferably, constitutes at least one forced hot air heater which creates a warm air curtain on or immediately adjacent to the end face of the roll. This is typically the same air being enclosed during packaging. Through this step, care is taken that without exerting any additional effort, just enough air is warmed-up to be needed later in a volume reduction.

The heating device can take the form of hot air jets which are directed under the axial projections of the packaging web. With this procedure, warm or hot air can be targeted to where the hot air is being enclosed. This procedure also ensures that only warm or even hot air is enclosed which, after cooling, contributes to a substantial reduction to a smaller volume.

In another preferred embodiment involving a device for applying an inner end face cover to an end face of a roll, the heating device constitutes, for at least one end face, a hollow probe which is movable substantially axially with its tip through the inner end face cover into the interior of the hollow roll core with the probe being connected to a hot air source. Because of the probe, hot air can be blown into the interior of the hollow roll core. Cold air is being expelled from the roll core under pressure from the hot air. The inner end face cover then prevents the hot air, particularly under the influence of the surrounding pressure, from immediately escaping from the interior of the roll core. The hot air having been retained in the interior of the roll core reduces its volume when cooling down. The volume of the interior of the roll core when compared to the pockets formed in the areas of the end faces is relatively large so that when cooling of the air occurs in the interior of the roll core, a relative strong suction is created which practically suctions off all of the air from the areas of the end faces.

It is preferred that the probe has an outer diameter which varies in the axial direction. By way of example, the probe at its tip or head could have a larger diameter than the shaft of the probe. When inserting the probe through the inner end face cover, not only is an opening formed through which the cold air can escape by being pushed by the hot air, but the exchange between the hot and cold air speeds up considerably. When packaging a roll, the up to now time intervals can be maintained.

To improve the air exchange, the probe can be surrounded by a sleeve, forming between the sleeve and the probe a circular space that is connected to the atmosphere. The sleeve also penetrates through the inner end face cover. Thereby, the circular space is surrounded by the sleeve preventing a closing of the circular space which might otherwise occur due to the elastic recovery of the inner end face cover.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components,and wherein.

DETAILED DESCRIPTION OF THE DRAWINGS

Figure 1:
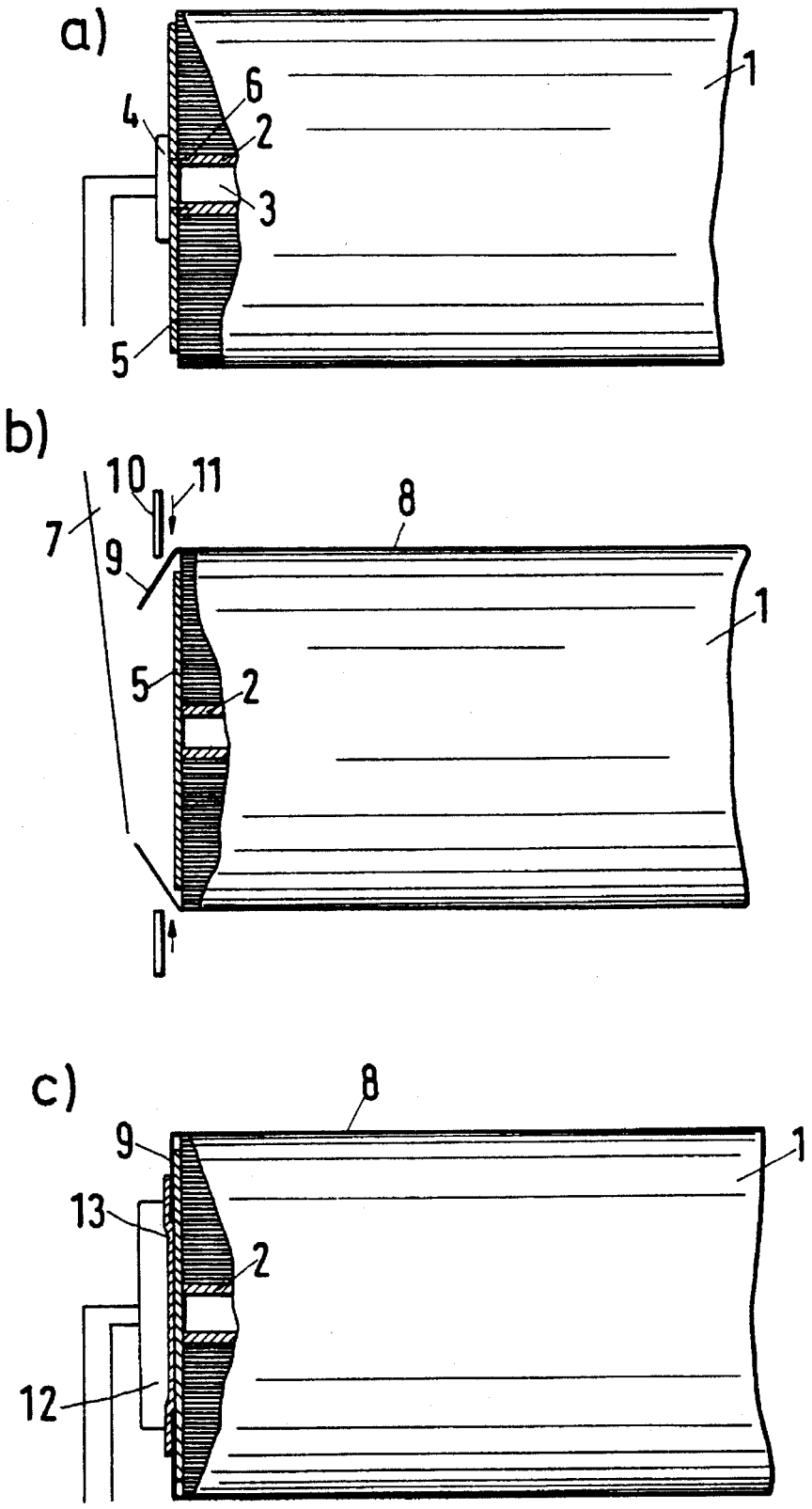
FIG. 1*a*–1*c* show a schematic sequence of packaging a material-web roll.

Referring now to FIGS. 1*a*–1*c*, a material-web roll 1 is wound on a hollow roll core 2 having an air filled interior space 3. With the aid of an applying head 4, an inner end face cover 5 is applied to roll core 2. As illustrated in FIG. 1*a*, inner end face cover 5 is fastened to roll core 2, by way of nails or staples 6.

The roll 2, having the inner end face covers 5 applied thereto, is shrouded with packaging web 7. The shroud, as a general rule, is multi-layered and has axial projections 9 because the packaging web 7 is generally wider than the roll 1. The axial projections are pleated with the aid of paddle wheels 10 and are abutted against the end faces of roll 1, that is, against the outer sides of the inner end face covers 5. The paddle wheels 10 can be moved radially inwardly in the direction of arrow 11 in order to achieve a possible close abutment of the packaging web 7 against the end face of roll 1.

With the aid of a further second applying head 12, an outer end face cover 13 is applied to the end faces of roll 1. Face cover 13 can be glued, to the end faces of roll 1 so that face cover 13 is fastened to the outside of the pleated projections 9 of shroud 8.

Figure 2:
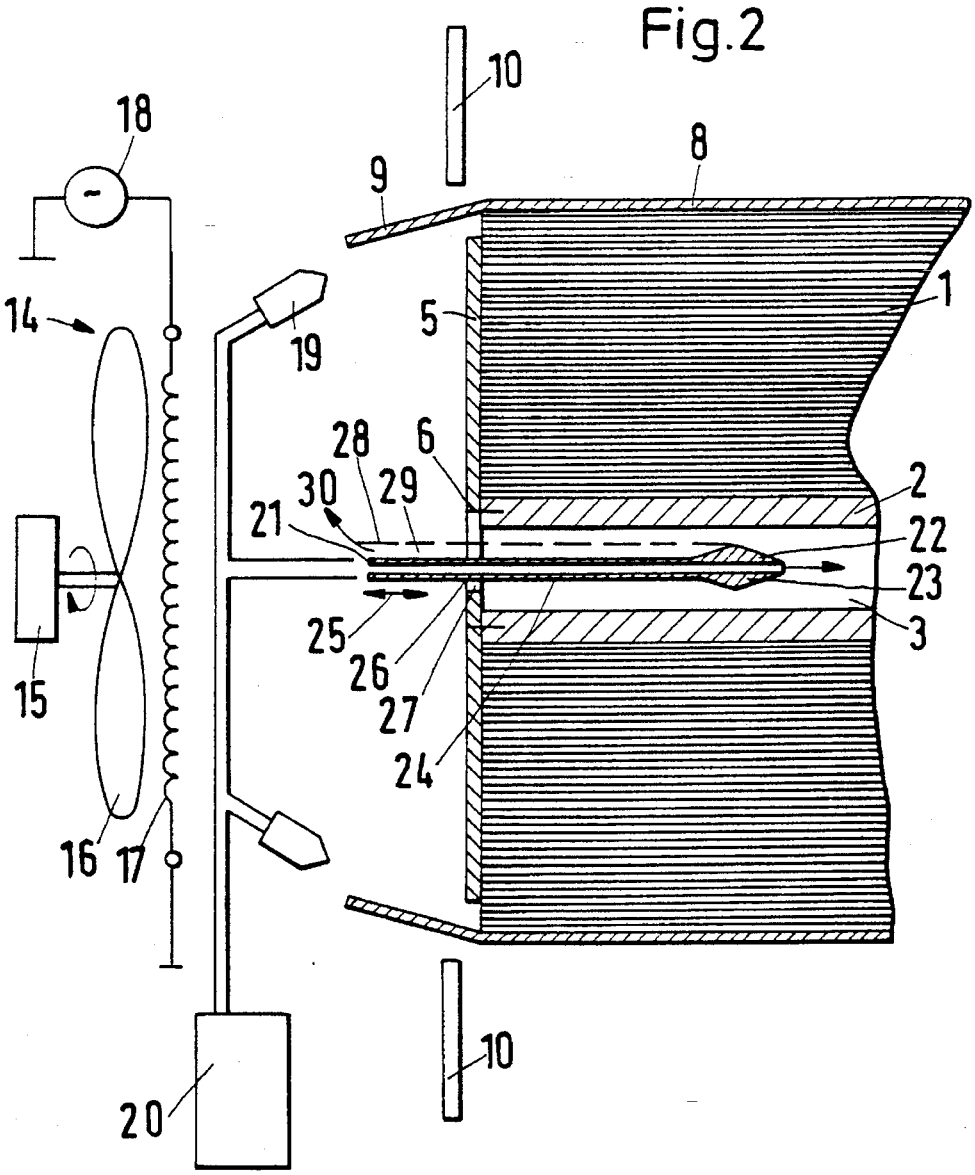
FIG. 2 shows a more detailed illustration of a packaging station according to FIG. 1*b*.

When the packaging web 7 is pleated, with the aid of paddle wheels 10, as well as when the outer end face covers 13 are applied to the pleats, one cannot avoid air from being enclosed within the web roll 1. Therefore, as illustrated at FIG. 2, the pleating station of FIG. 1*b* has hot air blown into the cylindrical space formed by the shroud 8 and the projection 9. When the projections 9 are pleated and when the outer end face cover 13 is being applied, the air being enclosed into the cylindrical space is hot or it least quite warm. While blowing in hot air, cold air is also removed from this area, that is, from the interior of the package.

Cold air has a greater specific weight than hot air so that as a result a portion of the air mass is being removed from the interior of the package. When hot air is cooling off, its volume is being reduced. Therefore, air pockets that were created during pleating or when the outer end face cover was applied, disappear to the extent that any air volume still enclosed is not enough to burst the package when it is being deposited on one of its end faces.

For the production of hot air in the space delimited by the shroud 8 and the projection 9, in other words, in the interior of the package, many different possibilities are contemplated. As a first exemplary embodiment, a forced air heater includes a motor 15 driving a fan 16, and a heating coil 17. The heating coil 17 is supplied with an electric current emanating from a source 18. The forced air heater produces a hot air curtain in front of the end face of roll 1, so that any air being enclosed during the pleating of the projections 9 is in a heated state.

As a second exemplary embodiment, hot air jets 19 can be provided which are connected to a hot air source 20 and are directed sideways under the projections 9. Thus, hot air is blown under the slanting pleats to effect a heat exchange between the pleats and roll 1. As illustrated, the air exchange occurs when the axial projections are still substantially unpleated. However, the hot air jets can be located further radially inwardly and thereby be directed in a further slant in the radial outward direction. Thus, the hot air can still effectively be introduced when the projections 9 are in a more advanced state of being pleated.

As a third exemplary embodiment, a hollow probe 21 can be used which is pushed through the end face cover 5 with its head 22. The probe 21 is also connected to a source of hot air 20. By means of the probe 21, hot air can be blown into the interior space 3 of roll core 2. The probe 21 has a head 23 whose outer diameter is larger than shaft 24 of the probe. Thus, the opening formed when inserting the probe 21 in the direction of double arrow 25, is larger than the outer diameter of shaft 24. A circular space is created outside of shaft 24 through which the cold air is pushed outwardly from the inner space 3 of the roll core. The exchange of air happens relatively quickly. Alternatively or even additionally, the probe could be provided with a sleeve 28 (shown in phantom) at least over part of its circumference which forms a circular space between itself and the shaft 24. This sleeve 28 enables the air to escape from the inner space 3 in the direction of arrow 30 to the outside into the ambient air.

The volume of the interior space 3 is relatively large when compared to the sum of both areas of the end faces of roll 1 and the volumes of the air enclosed therein. When the total of the air in the interior space 3 is warmed up, prior to closing the package and then after closing the same, the air contracts again because of cooling off, and a relatively large reduction of the air volume occurs. As a general rule, the end face cover 5 does not completely abut against the end face of roll 1, so that from between the inner end face cover 5 and roll 1, an air exchange can take place between the interior space 3 and the end face of roll 1. Thus, the air at the end face of roll 1 is practically suctioned away so that the package is substantially free of air at its end faces.

All of the three aforementioned exemplary embodiments can be employed collectively at the same time. In some instances, the forced air heater should be movable to afford enough space for the reciprocation of probe 21.

Figure 3:
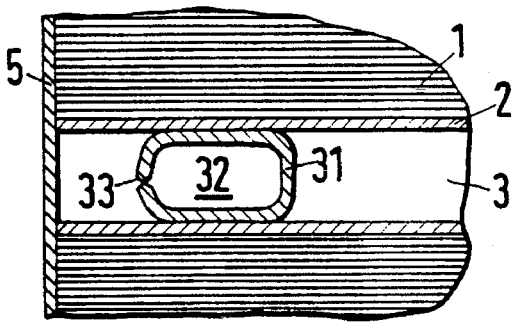
FIG. 3 shows a sectional view through a part of a packaging roll.

Another alternative embodiment for reducing the air volume within the package is shown in FIG. 3. An auxiliary body 31 is inserted into the interior space 3 of roll core 2. Illustrated is a container having a substantially air evacuated hollow space 32 which is in communication with the atmosphere by way of a throttle opening 33. The throttle opening 33 is closed after the auxiliary body 31 has been evacuated. The closure is removed only after the auxiliary body 31 has already been inserted into the interior space 3 of roll core 2 and just prior to closing the package. Because of the throttled opening 33, only a slow flow of the surrounding air into the hollow space 32 occurs. Thus, the auxiliary body 31 suctions the air from its surroundings. If the closing of the package is achieved quickly enough, the auxiliary body 31 then can only suction air from the interior of the closed package and it contributes to the removal of trapped air from areas most detrimental to the handling of a packaged roll.

From the foregoing description, it will be appreciated that the present invention makes available, a compact, cost efficient method and arrangement for the packaging of a material-web roll. Having described the presently preferred exemplary embodiment of a new and improved method and apparatus for the packaging of a material-web roll in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

What is claimed is:

1. A method of packaging a material-web roll comprising the steps of:

surrounding said roll on all sides with packaging material having an axial projection at the end of said roll;

removing a portion of the cold air mass from the interior formed by said projecting packaging material;

pleating said axial projection against the end of said roll; and reducing the volume of the enclosed air causing the pleats to be substantially void of air remnants.

2. The method according to claim 1, wherein removing a portion of air including the steps of warming at least a portion of the cold air in the interior of the package, closing the package and thereafter cooling the air.

3. The method according to claim 1, wherein the warming portion of air includes including the step of creating a hot air current in front of an end face of the roll prior to closing the packaging material.

4. The method according to claim 1, including the step of blowing warmed-up air into the interior of the packaging material prior to closing the package.

5. The method according to claim 1, including the steps of fastening an inner end face cover to a hollow roll core of said roll and thereafter filling the interior of said roll core with warmed-up air.

6. The method according to claim 5, including the steps of providing a through opening in the inner end face cover and creating a communication from the interior of said roll core to the outside of said end face cover through which the warmed-up air is being blown into said interior.

7. The method according to claim 6, including the steps of inserting at least one probe through said through opening and blowing hot air through said probe into the interior of said roll core, whereby the air being expelled escapes between the probe and a circumference of said through opening.

8. The method according to claim 2, wherein the step of warming the air occurs while pleating said packaging material at an end face of said roll.

9. The method according to claim 1, wherein prior to the step of closing the packaging material, an auxiliary body is placed into the interior of said packaging material, said auxiliary body consuming at least a portion of the enclosed air.

10. A method of packaging a material-web roll comprising the steps of:

surrounding said roll on all sides with packaging material having an axial projection at the end of said roll;

removing a portion of the cold air mass frown the interior formed by said projecting packaging material;

pleating said axial projection against the end of said roll; and reducing the volume of the enclosed air by placing an auxiliary body into the interior of said packaging material prior to the step of pleating the packaging material causing the pleats to be substantially void of air remnants, said auxiliary body consuming at least a portion of the enclosed air, wherein the auxiliary body is a container being partially evacuated of air and having a closed throttle opening; and opening the throttle opening shortly before closing the package.

11. The method according to claim 10, including the step of placing said auxiliary body within a hollow roll core of said roll.

* * * * *